US010221854B2

(12) United States Patent
Yamashita

(10) Patent No.: US 10,221,854 B2
(45) Date of Patent: Mar. 5, 2019

(54) IMPELLER AND ROTARY MACHINE PROVIDED WITH SAME

(71) Applicant: MITSUBISHI HEAVY INDUSTRIES COMPRESSOR CORPORATION, Tokyo (JP)

(72) Inventor: Shuichi Yamashita, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 338 days.

(21) Appl. No.: 14/912,416

(22) PCT Filed: Sep. 16, 2014

(86) PCT No.: PCT/JP2014/074448
§ 371 (c)(1),
(2) Date: Feb. 17, 2016

(87) PCT Pub. No.: WO2015/053051
PCT Pub. Date: Apr. 16, 2015

(65) Prior Publication Data

US 2016/0195094 A1 Jul. 7, 2016

(30) Foreign Application Priority Data

Oct. 9, 2013 (JP) ..... 2013-212119

(51) Int. Cl.
*F04D 17/12* (2006.01)
*F04D 17/10* (2006.01)
(Continued)

(52) U.S. Cl.
CPC ..... *F04D 17/10* (2013.01); *F04D 17/122* (2013.01); *F04D 29/284* (2013.01); *F04D 29/30* (2013.01);
(Continued)

(58) Field of Classification Search
None
See application file for complete search history.

(56) References Cited

U.S. PATENT DOCUMENTS

2009/0035122 A1 2/2009 Yagi et al.
2010/0129224 A1 5/2010 Shibata et al.
2012/0189454 A1 7/2012 Iwakiri et al.

FOREIGN PATENT DOCUMENTS

JP 2009-57959 A 3/2009
JP 2010-151126 A 7/2010
(Continued)

OTHER PUBLICATIONS

International Search Report (form PCT/ISA/210), dated Dec. 16, 2014, for International Application No. PCT/JP2014/074448, along with an English translation.
(Continued)

*Primary Examiner* — Igor Kershteyn
*Assistant Examiner* — Theodore Ribadeneyra
(74) *Attorney, Agent, or Firm* — Birch, Stewart, Kolasch & Birch, LLP

(57) ABSTRACT

The impeller is provided with a disk that rotates about an axis line, and a plurality of blades provided at intervals around the circumference of the disk. Defining the blade angle of the tip of each blade as a first blade angle, the tip has a constant-tip-angle area in which the first blade angle is constant from an inlet where fluid flows in toward an outlet side, and an increasing-tip-angle area that is continuous with the outlet side of the constant-tip-angle area and that has a gradually increasing first blade angle towards the outlet.

20 Claims, 5 Drawing Sheets

(51) Int. Cl.
*F04D 29/30* (2006.01)
*F04D 29/28* (2006.01)

(52) U.S. Cl.
CPC .. *F05D 2240/301* (2013.01); *F05D 2240/307* (2013.01)

(56) References Cited

FOREIGN PATENT DOCUMENTS

| | | | |
|---|---|---|---|
| JP | 2011-226398 | A | 11/2011 |
| JP | 2011-236919 | A | 11/2011 |
| JP | 4888436 | B2 | 2/2012 |
| JP | 2014-109193 | A | 6/2014 |

OTHER PUBLICATIONS

Written Opinion of the International Searching Authority (form PCT/ISA/237), dated Dec. 16, 2014, for International Application No. PCT/JP2014/074448, along with an English translation.
Search Report dated May 19, 2017 in counterpart application EP 14852044.8.

IMPELLER AND ROTARY MACHINE PROVIDED WITH SAME

TECHNICAL FIELD

The present invention relates to an impeller and a rotary machine which is provided with the impeller.

BACKGROUND ART

In a rotary machine such as a centrifugal compressor, an impeller (a bladed wheel) provided so as to be rotatable relative to a casing, is provided inside of the casing. The rotary machine rotates the impeller, thereby increasing the pressure of a fluid drawn in from the outside of the casing and discharging the fluid to the outside in a radial direction of a flow path in the impeller. In the rotary machine such as a centrifugal compressor, the shape of a blade which is provided in the impeller is optimized in order to attain improvement in performance.

For example, PTL 1 discloses a technique relating to the shape of such a blade. In this centrifugal compressor, the distributions of a blade angle on the tip side and a blade angle on the root side of the blade are defined. Specifically, the blade angle on the tip side of the blade is formed in a curved shape having an angle distribution in which the angle becomes a local maximum point before it reaches a middle portion along a flow path and becomes the minimum after the middle portion. On the other hand, the blade angle on the root side of the blade is formed in a curved shape having an angle distribution in which the angle becomes an angle smaller than the blade angle on the tip side of the blade at a fluid inflow port, and becomes a local maximum point larger than the blade angle on the tip side before it reaches a middle portion.

CITATION LIST

Patent Literature

[PTL 1] Japanese Patent No. 4888436

SUMMARY OF INVENTION

Technical Problem

However, in the blade formed in the shape as described above, since a change of the blade angle is large, a change of the shape of the blade becomes larger. For this reason, the generation of a shock wave or peeling in the vicinity of an impeller inlet where a fluid flows in is promoted, and thus, loss is increased, and therefore, the fluid cannot be efficiently compressed.

The present invention provides an impeller in which it is possible to improve compression efficiency, and a rotary machine provided with the impeller.

Solution to Problem

According to an aspect of the present invention, there is provided an impeller including: a disk which rotates about an axis line; and a plurality of blades which are provided at intervals in a circumferential direction at the disk and rotate integrally with the disk, thereby guiding a fluid which flows inward from an axis line direction in which the axis line extends, toward the outside in a radial direction with respect to the axis line, in which among angles that a tangential line in a projection curve obtained by projecting a center curve of a thickness of the blade from the axis line direction to the disk makes with an imaginary straight line orthogonal to a straight line which connects a tangential point between the projection curve and the tangential line and the axis line, an angle which is formed on a rear side in a rotation direction of the disk and an outer periphery side of the disk is defined as the blade angle, and in a case where the blade angle of a tip of the blade is defined as a first blade angle, the tip has a constant-tip-angle area in which the first blade angle is constant from an inlet where the fluid flows in, toward an outlet side where the fluid flows out, and an increasing-tip-angle area which is continuous with the outlet side of the constant-tip-angle area and in which the first blade angle gradually increases towards the outlet.

According to such an impeller, the fluid which has flowed into the impeller can continuously and smoothly flow without causing a discontinuous change associated with a change of the blade angle at the inlet of the tip. In this way, the generation of a shock wave or peeling which occurs when the fluid which has flowed in from the inlet collides with the blade is reduced, and thus, it is possible to reduce pressure loss. Further, it is possible to continuously and stably compress the fluid which flows on the tip side of the blade, among the fluid which has flowed in. Therefore, it is possible to efficiently compress the fluid while reducing pressure loss when the fluid flows in, at the inlet.

In the impeller according to another aspect of the present invention, in the increasing-tip-angle area, a first angle area which is continuous with the outlet side of the constant-tip-angle area, and a second angle area which is continuous with the outlet side of the first angle area through an inflection point and in which a mean gradient that is a rate of change of the blade angle is smaller than that in the first angle area, may be formed.

According to such an impeller, it is possible to prevent the first blade angle from becoming too large at the outlet, even when the first blade angle gradually increases. That is, the flow of the fluid flowing toward the outlet can be prevented from being disturbed due to a secondary flow, which is the flow of a low energy fluid which flows toward the blade provided in the circumferential direction, becoming stronger due to the first blade angle on the outlet side being large. In this way, loss occurring in the fluid which flows along the tip side of the blade is reduced, and thus, a reduction in compression efficiency can be prevented.

In the impeller according to another aspect of the present invention, in a case where the blade angle of a hub of the blade is defined as a second blade angle, the hub may have an increasing-hub-angle area in which the second blade angle gradually increases toward the outlet side from the inlet, and a decreasing-hub-angle area which is continuous with the outlet side of the increasing-hub-angle area through a local maximum point at which the second blade angle becomes the maximum, and in which the second blade angle gradually decreases towards the outlet.

According to such an impeller, it is possible to continuously and stably compress the fluid flowing along the hub side of the blade, among the fluid which has flowed in. Further, the second blade angle can be prevented from becoming too large at the outlet. That is, the flow of the fluid flowing toward the outlet can be prevented from being disturbed due to a secondary flow that is the flow of a low energy fluid, which flows toward the blade provided in the circumferential direction, becoming stronger due to the second blade angle on the outlet side being large. In this way, loss occurring in the fluid which flows along the hub side of the blade is reduced, and thus, a reduction in compression efficiency can be prevented.

In the impeller according to another aspect of the present invention, the increasing-hub-angle area may be formed such that a mean gradient, which is a rate of change of the blade angle, is larger than that in the increasing-tip-angle area.

According to such an impeller, in the blade, the tip can be formed to have a gentler change in shape than in the hub. Therefore, loss occurring when the fluid flowing along the tip side in the blade collides with the blade is reduced, and thus, a difference in the loss of the fluid between the tip side and the hub side can be reduced. In this way, the flow of the fluid can be prevented from being disturbed due to a secondary flow which occurs in the direction of the tip from the hub due to the collapse of the pressure balance of the fluid on the tip side and the hub side. In this way, loss occurring in the fluid which flows through the impeller is reduced, and thus, a reduction in compression efficiency can be prevented.

In the impeller according to another aspect of the present invention, the local maximum point may be formed further toward the inlet side than the inflection point.

According to such an impeller, the flow path which is formed by the plural blades provided in the circumferential direction can be prevented from being temporarily narrowed. That is, if the blade angle increases, the shape of the blade changes in a direction widening the flow path, and therefore, the flow path through which the fluid flows is increased. Therefore, the local maximum point is formed further toward the inlet side than the inflection point, whereby it is not possible to continuously and smoothly narrow the flow path toward the outlet. In this way, it is possible to efficiently compress the fluid by making the fluid smoothly flow. In this way, it is possible to improve compression efficiency by the impeller by making the fluid efficiently flow.

In the impeller according to another aspect of the present invention, in a case where the blade angle of a hub of the blade is defined as a second blade angle, the second blade angle in the inlet of the blade may be formed to be larger than the first blade angle in the inlet of the blade.

Here, if the thickness of the hub of the blade is increased, the strength of the blade can be improved. However, if the thickness of the hub is increased, the area of the flow path is reduced by a corresponding amount. In contrast, in the above-described impeller, by making the second blade angle in the inlet larger than the first blade angle, it is possible to increase the area of the flow path of the inlet. Therefore, it is possible to secure the area of the flow path of the inlet while securing strength by designing the thickness of the hub to be relatively large.

In the impeller according to another aspect of the present invention, in a case where the blade angle of a hub of the blade is defined as a second blade angle, the second blade angle in the outlet of the blade and the first blade angle in the outlet of the blade may be formed to be the same.

According to such an impeller, a load occurring in the fluid over an area from the tip to the hub of the blade at the outlet can be made to be constant. That is, it is possible to make the pressure balances of the fluid on the tip side and the hub side in the outlet at the same time, and thus, the flow of the fluid can be prevented from being disturbed due to the occurrence of a secondary flow. In this way, pressure loss occurring in the fluid which flows out from the outlet of the impeller is reduced, and thus, a reduction in compression efficiency can be prevented.

In the impeller according to another aspect of the present invention, in a case where the blade angle of a hub of the blade is defined as a second blade angle, the first blade angle may be formed to be less than or equal to the second blade angle over an area from the inlet to the outlet.

Here, if the thickness of the hub of the blade is increased, the strength of the blade can be improved. However, if the thickness of the hub is increased, the area of the flow path is reduced by a corresponding amount. In contrast, in the above-described impeller, by making the second blade angle larger than the first blade angle over an area from the inlet to the outlet, it is possible to increase the area of the flow path over the entire area of the flow path. Therefore, it is possible to secure the area of the flow path of the entire area of the flow path while securing strength by designing the thickness of the hub to be relatively large.

According to still another aspect of the present invention, there is provided a rotary machine including: the impeller.

According to such a rotary machine, it is possible to improve performance by increasing efficiency as the rotary machine.

Advantageous Effects of Invention

According to the above-described impeller, it is possible to improve compression efficiency by making the fluid efficiently flow.

DESCRIPTION OF EMBODIMENTS

Hereinafter, a centrifugal compressor provided with an impeller of an embodiment according to the present invention will be described with reference to FIGS. 1 to 5.

Figure 1:
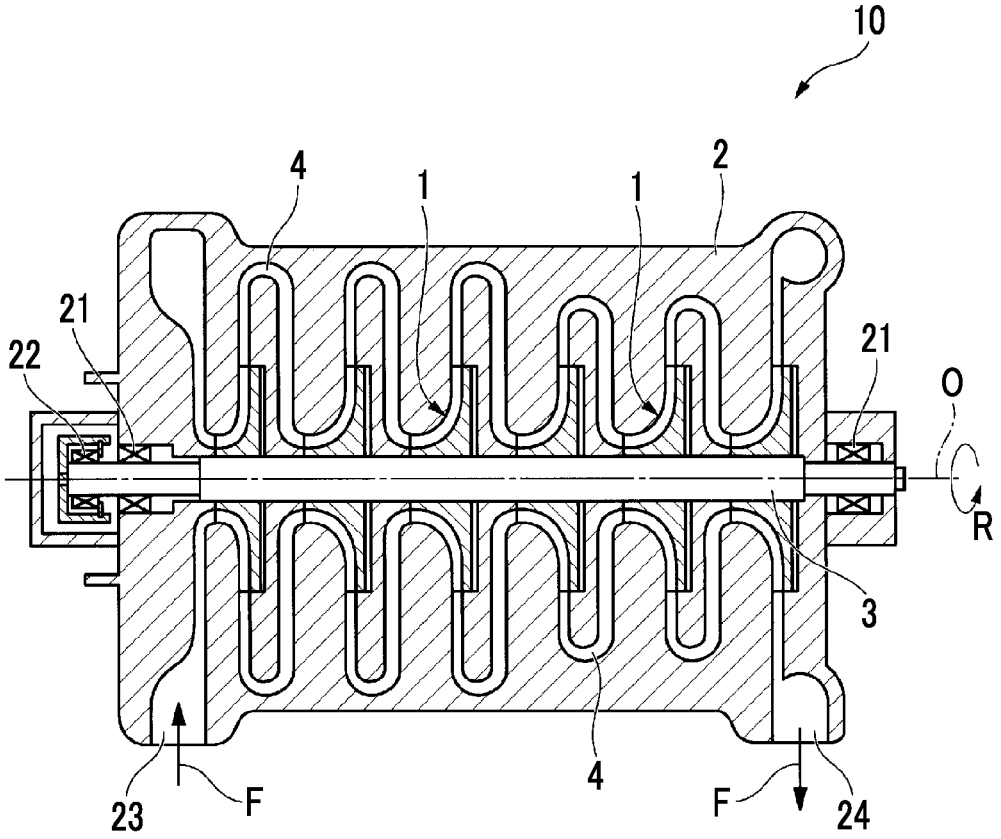
FIG. 1 is a sectional view showing the structure of a centrifugal compressor in this embodiment of the present invention.

A rotary machine in this embodiment is a centrifugal compressor 10, and in this embodiment, it is a multistage compressor. As shown in FIG. 1, the centrifugal compressor 10 is provided with a casing 2, a rotary shaft 3 which extends to be centered on an axis line O disposed so as to penetrate the casing 2, a plurality of impellers 1 integrally fixed to the rotary shaft 3 through keys so as to be able to rotate.

The casing 2 is formed so as to have a substantially cylindrical contour, and the rotary shaft 3 is disposed so as to penetrate the center thereof. Journal bearings 21 are provided at both ends in a direction of the axis line O, which is a direction in which the axis line O of the rotary shaft 3 extends, of the casing 2. A thrust bearing 22 is provided at one end of the casing 2.

A suction port 23 which makes a fluid F such as gas flow in from the outside is provided at an end portion on one side (the left side of the plane of paper in FIG. 1) which is a first end side in the direction of the axis line O, of the casing 2. A discharge port 24 which discharges the fluid F to the outside is provided at an end portion on the other side (the right side of the plane of paper in FIG. 1) which is a second end side in the direction of the axis line O, of the casing 2. The casing 2 is provided with an internal space which communicates with each of the suction port 23 and the discharge port 24 and in which diameter reduction and diameter expansion are repeatedly made. The impellers 1 are accommodated in the internal space. In the casing 2, a casing flow path 4 which makes the fluid F flowing through the impeller 1 flow from the upstream side to the downstream side is formed at a position which is between the impellers 1 when the impellers 1 are accommodated in the casing 2. In the casing 2, the suction port 23 and the discharge port 24 communicate with each other through the impellers 1 and the casing flow path 4.

The impellers 1 accommodated in the casing 2 are externally fitted to the rotary shaft 3, and thus, the rotary shaft 3 rotates about the axis line O along with the impellers 1. The rotary shaft 3 is supported by the journal bearings 21 and the thrust bearing 22 so as to be able to rotate with respect to the casing 2. The rotary shaft 3 is rotationally driven by a prime mover (not shown).

Figure 2:
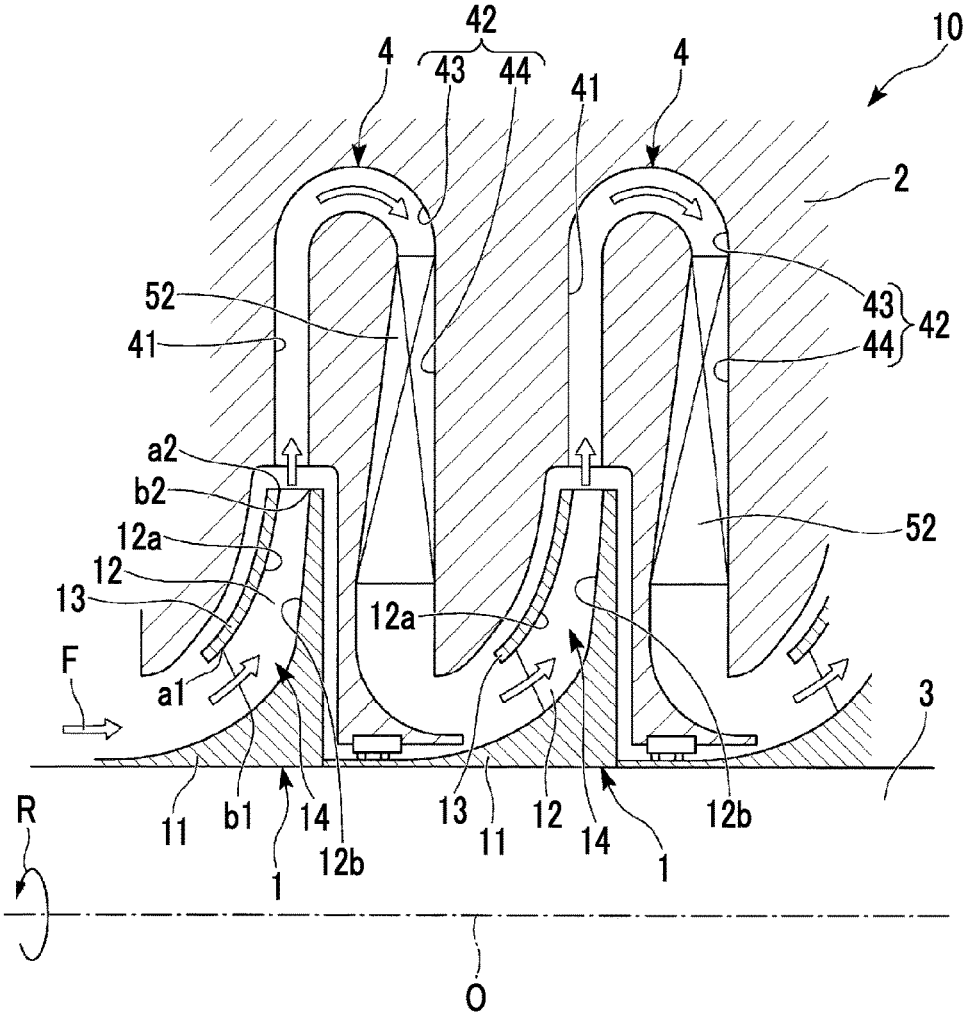
FIG. 2 is a main section sectional view showing the structure of the centrifugal compressor in this embodiment of the present invention.

The plurality of impellers 1 are accommodated inside of the casing 2 to be arranged at intervals in the direction of the axis line O which is a direction in which the axis line O of the rotary shaft 3 extends, as shown in FIG. 2.

Each of the impellers 1 has a substantially disk-shaped disk 11 in which a diameter gradually increases as it proceeds to the outflow side, and a plurality of blades 12 radially mounted on the disk 11 so as to stand toward one side in the axis line O of the rotary shaft 3 from the surface of the disk 11 and arranged in a circumferential direction. The impeller 1 has a cover 13 mounted so as to cover the plurality of blades 12 in the circumferential direction from one side in the direction of the axis line O. In the impeller 1, a gap is formed between the cover and the casing 2 such that the impeller 1 and the casing 2 do not come into contact with each other.

A flow path 14 which is a space partitioned such that the fluid F flows in a radial direction is formed in the impeller 1. The flow path 14 is formed by the surfaces of the disk 11 and the cover 13 which are respectively provided on both sides in the direction of the axis line O of a blade 12, along with two surfaces of a pair of blades 12 adjacent to each other. The blade 12 rotates integrally with the disk 11, whereby the flow path 14 draws in and discharges the fluid F. Specifically, the flow path 14 draws in the fluid F with one side in the direction of the axis line O, that is, the inside in the radial direction, in the blade 12, being an inlet where the fluid F flows in. The flow path 14 guides and discharges the fluid F with the outside in the radial direction being an outlet where the fluid F flows out.

In the disk 11, an end face which is directed to one side in the direction of the axis line O has a small diameter and an end face which is directed to the other side has a large diameter. The disk 11 gradually increases in diameter as it goes toward the other side from one side in the direction of the axis line O between these two end faces. That is, the disk 11 has substantially a disk shape when viewed in the direction of the axis line O and has substantially an umbrella shape as a whole.

A through-hole penetrating the disk 11 in the direction of the axis line O is formed on the inside in the radial direction of the disk 11. The rotary shaft 3 is inserted into and fitted to the through-hole, whereby the impeller 1 is fixed to the rotary shaft 3, thereby becoming integrally rotatable.

The cover 13 is a member provided integrally with the blades 12 so as to cover the plurality of blades 12 from one side in the direction of the axis line O. The cover 13 has substantially an umbrella shape, which gradually increases in diameter as it goes toward the other side from one side in the direction of the axis line O. That is, in this embodiment, the impeller 1 is a closed impeller having the cover 13.

Figure 3:
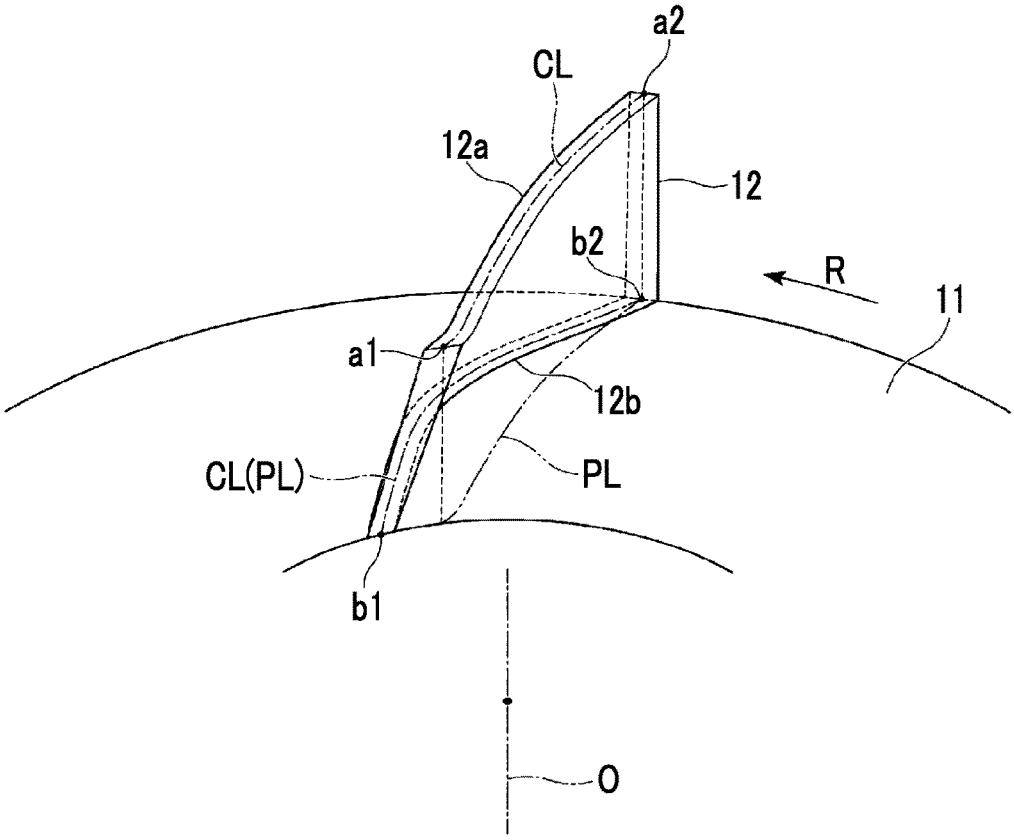
FIG. 3 is a schematic diagram showing the shape of a blade of an impeller in this embodiment of the present invention.

The plurality of blades 12 are disposed at certain intervals in the circumferential direction around the axis line O, that is, a rotation direction R, so as to stand near the cover 13 from the disk 11 to one side in the direction of the axis line O about the axis line O. Here, a root end portion which is the disk 11 side of the blade 12 and is connected to the disk 11 is referred to as a hub 12*b*, and a tip portion which is the cover 13 side of the blade 12 is referred to as a tip 12*a*. As shown in FIG. 3, the blade 12 is curved in different shapes at the hub 12*b* of the blade 12 and the tip 12*a* of the blade 12. That is, each of the blades 12 is formed so as to be three-dimensionally curved toward the rear side in the rotation direction R as it goes toward the outside from the inside in the radial direction of the disk 11. Specifically, the blade 12 is formed such that a blade angle β of the tip 12*a* and a blade angle β of the hub 12*b* have different angle distributions. For this reason, an outline a1-a2 of the tip portion of the blade 12 toward the outlet from the inlet and an outline b1-b2 of the root end portion of the blade 12 toward the outlet from the inlet are different from each other. In addition, in FIG. 3, the cover 13 is omitted.

Figure 4:
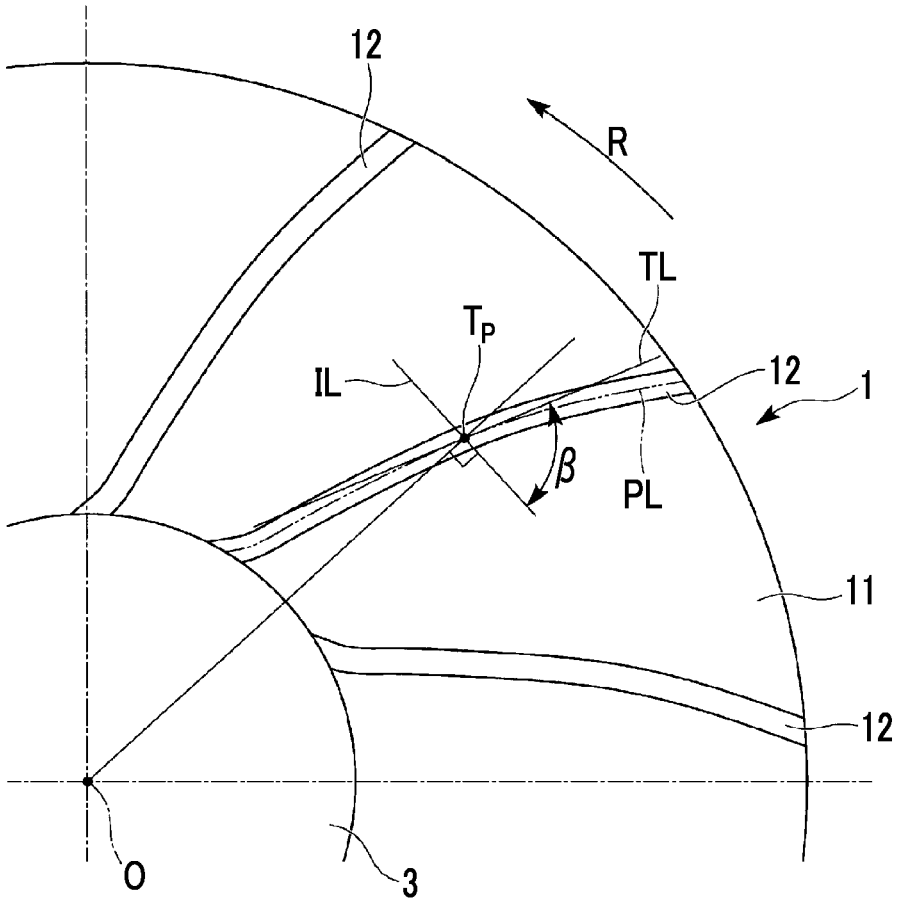
FIG. 4 is a schematic diagram defining blade angle distribution of the blade of the impeller in this embodiment of the present invention.

The blade angle β is an angle which determines the curved surface shape of the blade 12 over an area from the inlet (one side in the direction of the axis line O) of the blade 12, where the fluid F flows in, to the outlet (the outside in the radial direction with respect to the direction of the axis line O), where the fluid F flows out. Specifically, the blade angle β is derived by depicting a projection curve PL by projecting a center curve CL, which is an imaginary curve which is depicted by connecting the middle in a thickness direction of the blade 12 at the tip 12*a* and the middle in a thickness direction of the blade 12 at the hub 12*b*, from one side in the direction of the axis line O to the disk 11, as shown in FIGS. 3 and 4. That is, among angles which are formed by a tangential line TL in the projection curve PL and an imaginary straight line IL orthogonal to a straight line which connects a tangential point Tp between the projection curve PL and the tangential line TL and the axis line O, an angle which is formed on the rear side in the rotation direction R of the disk 11 and the outer periphery side of the disk 11 is defined as the blade angle β. The blade angle β of the tip 12*a* of the blade 12 is defined as a first blade angle β1, and the blade angle β of the hub 12*b* of the blade 12 is defined as a second blade angle β2.

Figure 5:
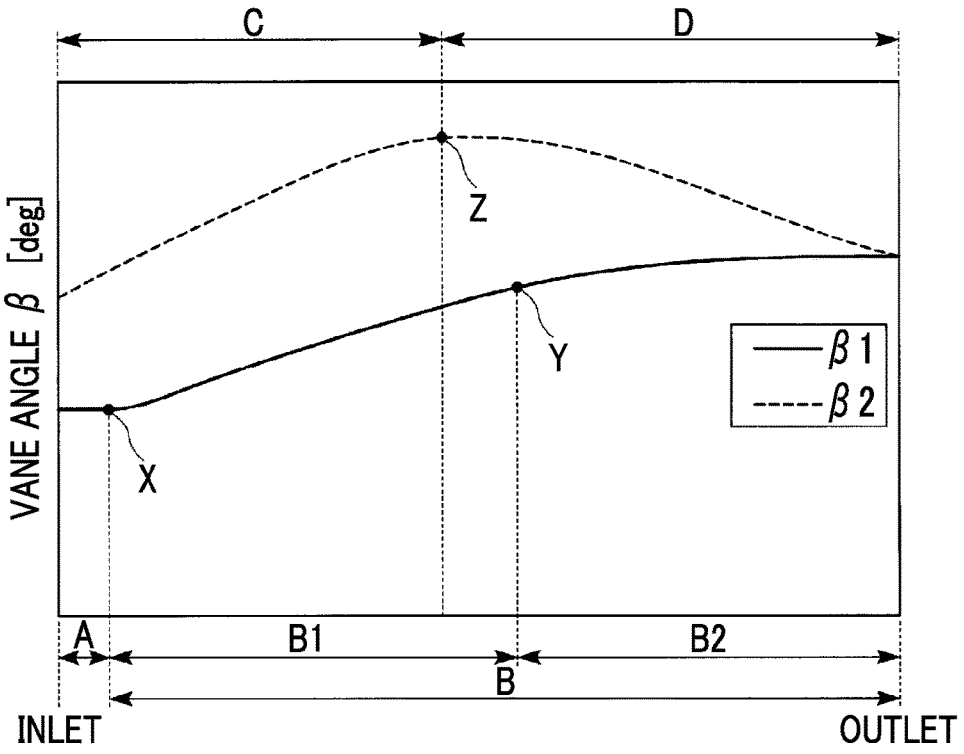
FIG. 5 is the distribution of a blade angle of the blade of the impeller in this embodiment of the present invention.

FIG. 5 shows distributions of the first blade angle β1 and the second blade angle β2.

In the tip 12*a*, a constant-tip-angle area A in which the first blade angle β1 is constant from the inlet where the fluid F flows in, toward the outlet side, and an increasing-tip-angle area B which is continuous with the outlet side of the constant-tip-angle area A and in which the first blade angle β1 gradually increases towards the outlet are formed.

The constant-tip-angle area A is a distribution area of the first blade angle β1 from the inlet in the tip 12*a* of the blade 12. In the constant-tip-angle area A, the first blade angle β1 does not change from a predetermined angle. The constant-tip-angle area A has a connection point X with the increasing-tip-angle area B, at which the first blade angle β1 begins to change, as an end point on the outlet side.

The increasing-tip-angle area B is a distribution area of the first blade angle β1 to the outlet, which is continuous from the constant-tip-angle area A in the tip 12*a* of the blade 12. In the increasing-tip-angle area B, unlike the constant-tip-angle area A, the first blade angle β1 gradually increases towards the outlet side. In the increasing-tip-angle area B, a changing point Y at which a mean gradient that is the rate of change of the blade angle β changes, a first angle area B1 which is continuous with the outlet side of the constant-tip-angle area A, and a second angle area B2 which is continuous with the first angle area B1 through an inflection point, are formed.

The changing point Y is a point at which the rate of change of an angle, at which the first blade angle β1 increases toward the outlet side, changes in the increasing-tip-angle area B. The changing point Y is an end point on the outlet side of the first angle area B1.

The first angle area B1 is continuous with the constant-tip-angle area A through the connection point X. In the first angle area B1, the first blade angle β1 gradually increases.

The second angle area B2 is continuous with the first angle area B1 through the inflection point. In the second angle area B2, a mean gradient has a value smaller than that in the first angle area B1 and the first blade angle β1 increases more gently than in the first angle area B1.

In the hub 12*b*, an increasing-hub-angle area C where the second blade angle β2 gradually increases toward the outlet side from the inlet, a local maximum point Z at which the second blade angle β2 becomes the maximum, and a decreasing-hub-angle area D which is continuous with the increasing-hub-angle area C through the local maximum point Z and in which the second blade angle β2 gradually decreases toward the outlet, are formed.

The increasing-hub-angle area C is a distribution area of the second blade angle β2 from the inlet in the hub 12*b* of the blade 12. The increasing-hub-angle area C is formed to be larger than the constant-tip-angle area A. That is, at the inlet of the blade 12, the second blade angle β2 is formed to be larger than the first blade angle β1. In the increasing-hub-angle area C, the second blade angle β2 gradually increases as it goes toward the outlet side from the inlet. A mean gradient in the increasing-hub-angle area C is larger than that in the increasing-tip-angle area B. That is, the mean gradient in the increasing-hub-angle area C is formed to be larger than in the first angle area B1 and the second angle area B2.

The local maximum point Z is a point at which the second blade angle β2 becomes the maximum. The local maximum point Z is an end point on the outlet side of the angle increase area of the hub 12*b*. The local maximum point Z is formed further toward the inlet side in the blade 12 than the inflection point.

The decreasing-hub-angle area D is continuous with the increasing-hub-angle area C through the local maximum point Z. In the decreasing-hub-angle area D, the second blade angle β2 gradually decreases as it goes toward the outlet from the local maximum point Z, such that the first blade angle β1 and the second blade angle β2 become the same at the outlet of the blade 12. That is, in the blade 12, even if there is a case where the first blade angle β1 coincides with the second blade angle β2 over an area from the inlet to the outlet of the blade 12, there is no case where the first blade angle β1 exceeds the second blade angle β2, and the first blade angle β1 is formed to be less than or equal to the second blade angle β2.

The casing flow path 4 described above is formed such that the pressure of the fluid F is increased in a stepwise fashion by connecting the respective impellers 1 to each other. The suction port 23 is connected to the inlet of the impeller 1 of the foremost stage provided at an end portion on one side in the direction of the axis line O. The outlet of each of the impellers 1 is connected to the inlet of the impeller 1 adjacent thereto, through the casing flow path 4. The outlet of the impeller 1 of the last stage provided at an end portion on the other side in the direction of the axis line O is connected to the discharge port 24.

The casing flow path 4 has a diffuser flow path 41 into which the fluid F is introduced from the flow path 14, and a return flow path 42 into which the fluid F is introduced from the diffuser flow path 41.

The inside in the radial direction of the diffuser flow path 41 communicates with the flow path 14. The diffuser flow path 41 makes the fluid F with the pressure increased by the impeller 1 flow toward the outside in the radial direction.

The return flow path 42 is made such that one end side communicates with the diffuser flow path 41 and the other end side communicates with the inlet of the impeller 1. The return flow path 42 has a corner portion 43 which inverts the direction of the fluid F, which has flowed toward the outside in the radial direction through the diffuser flow path 41, so as to be directed to the inside in the radial direction, and a straight portion 44 which extends toward the inside in the radial direction from the outside.

The straight portion 44 is the flow path 14 surrounded by a downstream-side side wall of a partition wall member mounted integrally with the casing 2, and an upstream-side side wall of an extension section which is mounted integrally with the casing 2 and extends to the inside in the radial direction. A plurality of return vanes 52 disposed at regular intervals in the circumferential direction about the axis line O of the rotary shaft 3 are provided in the straight portion 44.

Next, an operation of the centrifugal compressor 10 which is a rotary machine provided with the impeller 1 having the above-described configuration will be described.

In the centrifugal compressor 10 as described above, the fluid F which has flowed in from the suction port 23 flows in the order of the flow path 14, the diffuser flow path 41, and the return flow path 42 of the impeller 1 of the first stage and then flows in the order of the flow path 14, the diffuser flow path 41, and the return flow path 42 of the impeller 1 of the second stage. The fluid F which has flowed to a diffuser passage of the impeller 1 of the last stage flows out from the discharge port 24 to the outside.

The fluid F is compressed by each of the impellers 1 on the way to flow in the above-described order. That is, in the centrifugal compressor 10 of this embodiment, the fluid F is compressed in a stepwise fashion by the plurality of impellers 1, and in this way, a large compression ratio is obtained.

According to the impeller 1 as described above, the constant-tip-angle area A is formed at the inlet in the tip 12*a* of the blade 12, whereby the first blade angle β1 in the inlet of the tip 12*a* of the blade 12 becomes constant. For this reason, the fluid F which has flowed into the impeller 1 can continuously and smoothly flow, without causing a discontinuous change associated with a change of the blade angle β at the inlet of the tip 12*a*. In this way, the generation of a shock wave or peeling which occurs when the fluid F which has flowed from the inlet into the flow path 14 of the impeller 1 collides with the blade 12 is reduced, and thus, pressure loss can be reduced. Further, after the constant-tip-angle area A is formed at the inlet, the increasing-tip-angle area B is formed to be continuous through the connection point X. For this reason, it is possible to continuously and stably compress the fluid F flowing on the tip 12*a* side of the blade 12, of the fluid F which has flowed into the impeller 1. Therefore, it is possible to efficiently compress the fluid F while reducing pressure loss when the fluid F flows into the impeller 1, at the inlet. In this way, it is possible to improve compression efficiency by the impeller 1 by making the fluid F efficiently flow.

The first angle area B1 and the increasing-tip-angle area B are formed through the inflection point at the tip 12*a* of the blade 12, and the second angle area B2 having a smaller mean gradient than the first angle area B1 is formed at the outlet. Therefore, it is possible to prevent the first blade angle β1 from becoming too large at the outlet, even while gradually increasing the first blade angle β1. That is, the flow of the fluid F flowing toward the outlet can be prevented from being disturbed due to a secondary flow that is the flow of a low energy fluid which flows toward the blade 12 adjacent thereto in the circumferential direction becoming stronger due to the first blade angle β1 on the outlet side being large. In this way, loss occurring in the fluid F which flows along the tip 12*a* side of the blade 12 of the flow path 14 is reduced, and thus, a reduction in compression efficiency can be prevented.

The increasing-hub-angle area C where the second blade angle β2 gradually increases is formed at the hub 12*b* of the blade 12. Therefore, it is possible to continuously and stably compress the fluid F flowing along the hub 12*b* side of the blade 12, among the fluid F which has flowed into the impeller 1. The decreasing-hub-angle area D where the second blade angle β2 gradually decreases is formed to be continuous with the increasing-hub-angle area C through the local maximum point Z at which the second blade angle β2 becomes the maximum. For this reason, the second blade angle β2 can be prevented from becoming too large at the outlet. That is, the flow of the fluid F flowing toward the outlet can be prevented from being disturbed due to a secondary flow that is the flow of a low energy fluid which flows toward the blade 12 adjacent thereto in the circumferential direction becoming stronger due to the second blade angle β2 on the outlet side being large. In this way, loss occurring in the fluid F which flows on the hub 12*b* side of the blade 12 of the flow path 14 is reduced, and thus, a reduction in compression efficiency can be prevented.

The blade 12 is formed such that the mean gradient in the increasing-hub-angle area C is larger than that in the increasing-tip-angle area B. For this reason, in the blade 12, the tip 12*a* can be formed to have a gentler change in shape than in the hub 12*b*. Therefore, loss occurring when the fluid F flowing along the tip 12*a* side in the blade 12 collides with the blade 12 is reduced, and thus, a difference in loss of the fluid F between the tip 12*a* side and the hub 12*b* side can be reduced. In this way, the flow of the fluid F can be prevented from being disturbed due to a secondary flow occurring toward the tip 12*a* from the hub 12*b* due to the collapse of the pressure balance of the fluid F on the tip 12*a* side and the hub 12*b* side. In this way, loss occurring in the fluid F which flows through the flow path 14 of the impeller 1 is reduced, and thus, a reduction in compression efficiency can be prevented.

In the blade 12, the local maximum point Z is formed further toward the inlet side in the blade 12 than the inflection point. For this reason, the flow path 14 which is formed by the blades 12 adjacent to each other can be prevented from being temporarily narrowed. That is, if the blade angle β increases, the shape of the blade 12 changes in a direction widening the flow path 14, and therefore, the flow path 14 through which the fluid F flows is increased. Therefore, if the local maximum point Z is formed further toward the outlet side than the inflection point, it is not possible to sufficiently narrow the flow path 14 until the local maximum point Z even after the inflection point and the flow path 14 is rapidly narrowed after the local maximum point Z. On the other hand, if the local maximum point Z is formed further toward the inlet side than the inflection point, it is not possible to continuously and smoothly narrow the flow path toward the outlet. In this way, it is possible to efficiently compress the fluid F by making the fluid F smoothly flow. In this way, it is possible to improve compression efficiency by the impeller 1 by making the fluid F efficiently flow.

Here, if the thickness of the hub 12*b* of the blade 12 is increased, the strength of the blade 12 can be improved. However, if the thickness of the hub 12*b* is increased, the area of the flow path 14 is reduced by a corresponding amount. In contrast, the blade 12 of the impeller 1 is formed such that the second blade angle β2 is larger than the first blade angle β1 at the inlet. For this reason, it is possible to increase the area of the flow path 14 in the inlet. Therefore, it is possible to secure the area on the inlet side of the flow path 14 while securing strength by designing the thickness of the hub 12*b* to be relatively large.

The blade 12 is formed such that the first blade angle β1 and the second blade angle β2 become the same at the outlet of the blade 12. For this reason, a load occurring in the fluid F over an area from the tip 12*a* to the hub 12*b* of the blade 12 at the outlet can be made to be constant. That is, it is possible to make the pressure balances of the fluid F on the tip 12*a* side and the hub 12*b* side in the outlet at the same time, and thus, the flow of the fluid F can be prevented from being disturbed due to the occurrence of a secondary flow. In this way, pressure loss occurring in the fluid F which flows out from the outlet of the impeller 1 is reduced, and thus, a reduction in compression efficiency can be prevented.

In the blade 12 of the impeller 1, the second blade angle β2 is formed to be larger than the first blade angle β1 over an area from the inlet to the outlet of the blade 12. For this reason, it is possible to increase the area of the flow path 14 over the entire area of the flow path 14 from the inlet to the outlet. Therefore, it is possible to secure the area of the flow path 14 over the entire area of the flow path 14 while securing strength by designing the thickness of the hub 12*b* to be relatively large.

According to the rotary machine which is provided with the impeller 1 as described above, it is possible to use the impeller 1 in which compression efficiency is improve by making the fluid F efficiently flow. For this reason, it is possible to improve performance by increasing efficiency as the rotary machine.

An embodiment of the present invention has been described above in detail with reference to the drawings. However, each configuration in each embodiment, the combination thereof, or the like is one example, and addition, omission, substitution, and other changes of a configuration can be made within a scope which does not depart from the gist of the present invention. The present invention is not limited by the embodiment, but is limited only by the scope of the appended claims.

Further, in this embodiment, the blade 12 which is used in the impeller 1 has been described with the rotary machine being the centrifugal compressor 10. However, there is no limitation thereto, and the blade 12 may be used in the impeller 1 or the like of, for example, a water wheel or a gas turbine.

Further, in this embodiment, the closed impeller which is provided with the cover 13 has been described as an example. However, the present invention may be applied to a so-called open type impeller 1 (an open impeller) in which the tip 12*a* side of the blade 12 is covered with a shroud surface of the casing 2.

REFERENCE SIGNS LIST

F: fluid
R: rotation direction
10: centrifugal compressor
2: casing
21: journal bearing
22: thrust bearing
23: suction port
24: discharge port
3: rotary shaft
1: impeller
11: disk
12: blade
12*a*: tip
A: constant-tip-angle area
X: connection point
B: increasing-tip-angle area
Y: changing point
B1: first angle area
B2: second angle area
12*b*: hub
C: increasing-hub-angle area
Z: local maximum point
D: decreasing-hub-angle area
CL: center curve
PL: projection curve
TL: tangential line
Tp: tangential point
IL: imaginary straight line
P: blade angle
β1: first blade angle
β2: second blade angle
13: cover
14: flow path
4: casing flow path
51: diffuser vane
52: return vane
41: diffuser flow path
42: return flow path
43: corner portion
44: straight portion

The invention claimed is:

1. An impeller comprising:

a disk which rotates about an axis line; and a plurality of blades which are provided at intervals in a circumferential direction at the disk and rotate integrally with the disk, thereby guiding a fluid which flows inward from an axis line direction in which the axis line extends, toward the outside in a radial direction with respect to the axis line, wherein among angles that a tangential line in a projection curve obtained by projecting a center curve of a thickness of the blade from the axis line direction to the disk makes with an imaginary straight line orthogonal to a straight line which connects a tangential point between the projection curve and the tangential line and the axis line, an angle which is formed on a rear side in a rotation direction of the disk and an outer periphery side of the disk is defined as a blade angle, and in a case where the blade angle of a tip of the blade is defined as a first blade angle, the tip has a constant-tip-angle area in which the first blade angle is constant from an inlet where the fluid flows in, toward an outlet side where the fluid flows out, and an increasing-tip-angle area which is continuous with the outlet side of the constant-tip-angle area and in which the first blade angle gradually increases towards the outlet, and the first blade angle is the largest at the outlet.

2. The impeller according to claim 1, wherein in the increasing-tip-angle area, a first angle area which is continuous with the outlet side of the constant-tip-angle area, and a second angle area which is continuous with the outlet side of the first angle area through an inflection point and in which a mean gradient that is a rate of change of the blade angle is smaller than that in the first angle area, are formed.

3. The impeller according to claim 2, wherein in a case where the blade angle of a hub of the blade is defined as a second blade angle, the hub has an increasing-hub-angle area in which the second blade angle gradually increases toward the outlet side from the inlet, and a decreasing-hub-angle area which is continuous with the outlet side of the increasing-hub-angle area through a local maximum point at which the second blade angle becomes the maximum, and in which the second blade angle gradually decreases towards the outlet.

4. The impeller according to claim 3, wherein the increasing-hub-angle area is formed such that a mean gradient, which is a rate of change of the blade angle, is larger than that in the increasing-tip-angle area.

5. The impeller according to claim 4, wherein the local maximum point is formed further toward the inlet side than the inflection point.

6. The impeller according to claim 1, wherein in a case where the blade angle of a hub of the blade is defined as a second blade angle, the hub has an increasing-hub-angle area in which the second blade angle gradually increases toward the outlet side from the inlet, and a decreasing-hub-angle area which is continuous with the outlet side of the increasing-hub-angle area through a local maximum point at which the second blade angle becomes the maximum, and in which the second blade angle gradually decreases towards the outlet.

7. The impeller according to claim 1, wherein in a case where the blade angle of a hub of the blade is defined as a second blade angle, the second blade angle in the inlet of the blade is formed to be larger than the first blade angle in the inlet of the blade.

8. The impeller according to claim 1, wherein in a case where the blade angle of a hub of the blade is defined as a second blade angle, the second blade angle in the outlet of the blade and the first blade angle in the outlet of the blade are formed to be the same.

9. The impeller according to claim 1, wherein in a case where the blade angle of a hub of the blade is defined as a second blade angle, the first blade angle is formed to be less than or equal to the second blade angle over an area from the inlet to the outlet.

10. A rotary machine comprising: the impeller according to claim 1.

11. The impeller according to claim 2, wherein in a case where the blade angle of a hub of the blade is defined as a second blade angle, the second blade angle in the inlet of the blade is formed to be larger than the first blade angle in the inlet of the blade.

12. The impeller according to claim 3, wherein in a case where the blade angle of a hub of the blade is defined as a second blade angle, the second blade angle in the inlet of the blade is formed to be larger than the first blade angle in the inlet of the blade.

13. The impeller according to claim 4, wherein in a case where the blade angle of a hub of the blade is defined as a second blade angle, the second blade angle in the inlet of the blade is formed to be larger than the first blade angle in the inlet of the blade.

14. The impeller according to claim 5, wherein in a case where the blade angle of a hub of the blade is defined as a second blade angle, the second blade angle in the inlet of the blade is formed to be larger than the first blade angle in the inlet of the blade.

15. The impeller according to claim 6, wherein in a case where the blade angle of a hub of the blade is defined as a second blade angle, the second blade angle in the inlet of the blade is formed to be larger than the first blade angle in the inlet of the blade.

16. The impeller according to claim 2, wherein in a case where the blade angle of a hub of the blade is defined as a second blade angle, the second blade angle in the outlet of the blade and the first blade angle in the outlet of the blade are formed to be the same.

17. The impeller according to claim 3, wherein in a case where the blade angle of a hub of the blade is defined as a second blade angle, the second blade angle in the outlet of the blade and the first blade angle in the outlet of the blade are formed to be the same.

18. The impeller according to claim 4, wherein in a case where the blade angle of a hub of the blade is defined as a second blade angle, the second blade angle in the outlet of the blade and the first blade angle in the outlet of the blade are formed to be the same.

19. The impeller according to claim 5, wherein in a case where the blade angle of a hub of the blade is defined as a second blade angle, the second blade angle in the outlet of the blade and the first blade angle in the outlet of the blade are formed to be the same.

20. The impeller according to claim 6, wherein in a case where the blade angle of a hub of the blade is defined as a second blade angle, the second blade angle in the outlet of the blade and the first blade angle in the outlet of the blade are formed to be the same.

* * * * *